US006061045A

United States Patent [19]

Inaba

[11] Patent Number: 6,061,045

[45] **Date of Patent: *May 9, 2000**

[54] LIQUID CRYSTAL DISPLAY APPARATUS AND METHOD OF DRIVING SAME

[75] Inventor: Yutaka Inaba, Hino, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/665,947

[22] Filed: Jun. 19, 1996

[30] Foreign Application Priority Data

Jun. 19, 1995 [JP] Japan ..... 7-152048
Jun. 19, 1995 [JP] Japan ..... 7-152049

[51] Int. Cl.[7] ..... G09G 3/36
[52] U.S. Cl. ..... 345/95
[58] Field of Search ..... 345/94–97; 349/144

[56] References Cited

U.S. PATENT DOCUMENTS

| | | | |
|---|---|---|---|
| 4,738,515 | 4/1988 | Okada et al. | 350/350 |
| 4,778,260 | 10/1988 | Okada et al. | 350/350 |
| 4,830,467 | 5/1989 | Inoue et al. | 350/333 |
| 4,836,656 | 6/1989 | Mouri et al. | 350/350 |
| 4,878,740 | 11/1989 | Inaba et al. | 350/337 |
| 4,925,277 | 5/1990 | Inaba | 350/350 |
| 4,930,875 | 6/1990 | Inoue et al. | 350/333 |
| 4,932,759 | 6/1990 | Toyono et al. | 350/350 |
| 4,958,912 | 9/1990 | Inaba et al. | 350/332 |
| 4,958,915 | 9/1990 | Okada et al. | 350/345 |
| 5,026,144 | 6/1991 | Taniguchi et al. | 350/350 |
| 5,034,735 | 7/1991 | Inoue et al. | 340/784 |
| 5,046,823 | 9/1991 | Mori et al. | 359/56 |
| 5,057,928 | 10/1991 | Nagashima et al. | 345/96 |
| 5,132,818 | 7/1992 | Mouri et al. | 359/56 |
| 5,136,282 | 8/1992 | Inaba et al. | 340/784 |
| 5,215,678 | 6/1993 | Koden et al. | 252/299.61 |

(List continued on next page.)

FOREIGN PATENT DOCUMENTS

| | | |
|---|---|---|
| 2-153322 | 6/1990 | Japan . |
| 2-173724 | 7/1990 | Japan . |

OTHER PUBLICATIONS

A.D.L. Chandani et al., "Antiferroelectric Chiral Smectic Phases Responsible for the Tristable Switching in MHPOBC", Japanese Journal of Applied Physics, vol. 28, No. 7, Jul. 1989, pp. L1265–L1268.

*Primary Examiner*—Jeffery Brier
*Attorney, Agent, or Firm*—Fitzpatrick, Cella, Harper & Scinto

[57] ABSTRACT

A liquid crystal display apparatus is constituted from a display panel including scanning electrodes and data electrodes intersecting the scanning electrodes so as to form a matrix of pixels each comprising at least two sub-pixels at an intersection of the scanning electrodes and the data electrodes; a ferroelectric liquid crystal disposed between the scanning electrodes and the data electrodes and capable of assuming an antiferroelectric first stable state under application of no voltage and a ferroelectric second stable state and a ferroelectric third stable state under application of voltages corresponding to polarities of the applied voltages; polarizing means for discriminating the first stable state of the liquid crystal as a dark state, and the second and third stable states of the liquid crystal as bright states; and drive means for applying voltages to the scanning electrodes and the data electrodes so as to place the liquid crystal in the second stable state at a sub-pixel of the sub-pixels and in the third stable state at another sub-pixel of the sub-pixels when a pixel concerned is placed in bright state or drive means for sequentially selecting the scanning electrodes with skipping of N electrodes apart (N: positive integer) by applying selection voltages of polarities alternating for each selection to successively selected scanning electrodes. The drive means is effective in minimizing differences in transmittance and hue when viewed in an oblique direction to alleviate flickering.

11 Claims, 10 Drawing Sheets

U.S. PATENT DOCUMENTS 5,253,091 10/1993 Kimura et al. ..... 345/94
5,267,065 11/1993 Taniguchi et al. ..... 359/56
5,317,437 5/1994 Katakura ..... 349/144
5,356,561 10/1994 Shimizu et al. ..... 252/299.62
5,436,747 7/1995 Suzuki ..... 345/96
5,459,481 10/1995 Tanaka et al. ..... 345/95
5,469,281 11/1995 Katakura et al. ..... 359/56
5,471,229 11/1995 Okada et al. ..... 345/89
5,475,517 12/1995 Konuma et al. ..... 349/132
5,519,411 5/1996 Okada et al. ..... 345/89
5,521,727 5/1996 Inaba et al. ..... 359/56
5,532,713 7/1996 Okada et al. ..... 345/97
5,631,752 5/1997 Tanaka ..... 349/173

LIQUID CRYSTAL DISPLAY APPARATUS AND METHOD OF DRIVING SAME

FIELD OF THE INVENTION AND RELATED ART

The present invention relates to a liquid crystal display apparatus using a ferroelectric liquid crystal showing an anti-ferroelectric state and a ferroelectric state, and relates to a method of driving the liquid crystal display apparatus.

Hitherto, a liquid crystal display apparatus capable of assuming three optically stable states disclosed in, e.g., Japanese Laid-Open Patent Applications (JP-A) 2-153322 and 2-173724. Thereafter, it has been clarified that such three optically stable states results from anti-ferroelectricity of a liquid crystal by Chandani et al., Jpn. J. Appl. Phys., 28, p. L1265 (1989).

According to the above reference, when a ferroelectric liquid crystal showing anti-ferroelectricity is disposed with a small gap between a pair of electrode substrates for constituting a liquid crystal cell, the formation of a helical structure of liquid crystal molecules in a direction parallel to the substrate surface is suppressed, similarly as in an ordinary ferroelectric liquid crystal, and assumes a smectic layer structure as shown in FIG. 1A under no electric field (E=0) wherein liquid crystal molecules are tilted in directions which are opposite to each other and alternate layer by layer of smectic layers, thereby providing an average optical axis substantially parallel to the smectic layer normal.

If an electric field exceeding a prescribed value (absolute value) of positive or negative polarity (E>0, E<0) is applied to the liquid crystal, a transition to a ferroelectric state is caused, wherein all the liquid crystal molecules are tilted rightwards as shown in FIG. 1B or leftwards as shown in FIG. 1C to provide a correspondingly tilted optical axis in the same direction of the tilted liquid crystal molecules, respectively. These tilted optical axes as shown in FIGS. 1B and 1C are symmetrical with respect to the smectic layer normal.

In case where the ferroelectric liquid crystal showing antiferroelectricity is used in a liquid crystal display apparatus, the liquid crystal cell containing such a ferroelectric liquid crystal as described above is generally sandwiched between a pair of polarizers arranged in cross nicols and having polarizing axes as shown in FIGS. 1A–1C by crossed arrows, respectively, so that one polarizer (on one substrate side) has a polarizing axis disposed parallel to the smectic layer normal and the other polarizer (on the other substrate side) has a polarizing axis disposed perpendicular to the smectic layer normal. In this polarizer arrangement, due to birefringence of liquid crystal, the ferroelectric liquid crystal assumes an antiferroelectric state (hereinafter called a "antiferroelectric first stable state") observed as a dark state under no electric field application (E=0) and assumes two ferroelectric states (hereinafter called a "ferroelectric second stable state" and a "ferroelectric third stable state" observed as two types of bright states under electric field application (E>0, E<0).

Herein, the above-mentioned ferroelectric liquid crystal showing antiferroelectricity (i.e., antiferroelectric first stable state and ferroelectric second and third stable states) is referred to as an "antiferroelectric liquid crystal" or a "ferroelectric liquid crystal assuming three stable states".

The above-mentioned JP-A 2-173724 discloses a method of using the above-mentioned properties of a ferroelectric liquid crystal assuming three stable states (antiferroelectric liquid crystal) and displaying two bright states while inverting an applied voltage (E>0, E<0) for each prescribed period (or prescribed frame) (hereinafter, this method is called "polarity-inversion drive method"). JP-A 2-173724 also discloses an antiferroelectric liquid crystal display apparatus having a simple matrix structure and driven by the polarity-inversion drive method with, e.g., a drive waveform as shown in FIG. 2.

FIG. 2 shows a voltage waveform with time applied to a liquid crystal (or a pixel displaying bright states).

According to this method, the polarity of the voltage applied to pixels in a bright state is inverted for each frame as shown in FIG. 2, the voltage applied to the liquid crystal becomes averagely zero, thereby obviating the deterioration of the liquid crystal due to DC voltage component.

The polarity-inversion drive method for each frame as described above, however, encounters a problem of causing "flickering" particularly when a liquid crystal display apparatus (panel) is viewed in an oblique direction. This may be attributable to the following phenomenon.

FIGS. 3A–3C show the alignments (orientations) of liquid crystal molecules in respective states (dark and bright states) and polarizing axes of the pair of polarizers sandwiching the pair of substrates when viewed in an oblique direction (e.g., lower right-oblique direction), wherein FIG. 3A shows an alignment of liquid crystal molecules in a dark state and FIGS. 3B and 3C show alignments of liquid crystal molecules in two bright states, respectively. These alignments of liquid crystal molecules correspond to those of liquid crystal molecules when viewed normally or from a frontal position as shown in FIGS. 1A–1C, respectively.

In this regard, the alignment of liquid crystal molecules shown in FIG. 3B (viewed in an oblique direction) is not very different in effective refractive index anisotropy from that shown in FIG. 1B (viewed from a frontal position) since liquid crystal molecules are viewed from a position substantially or nearly perpendicular to the longer (optical) axis direction thereof in either case. On the other hand, the alignment of liquid crystal molecules shown in FIG. 3C (viewed in an oblique direction) remarkably lowers a refractive index anisotropy when compared with that shown in FIG. 1C (viewed from a frontal position) since, in FIG. 3, liquid crystal molecules are viewed from a position closer to the longer axis direction thereof. For this reason, when liquid crystal molecules are viewed in an oblique direction, a difference in transmittance between the alignments of liquid crystal molecules in two bright states as shown in FIGS. 3B and 3C occurs and two bright states are alternately switched from each other for each frame, thus being observed as "flickering" phenomenon.

Further, when the liquid crystal display panel is viewed in an oblique direction in the above-mentioned manner, the optical path length is increased, the retardation is deviated from an optimum value particularly in the alignment of liquid crystal molecules shown in FIG. 3B to provide a yellowish tint, thus also causing "flickering".

When a liquid crystal display panel having a matrix electrode structure wherein a plurality of scanning signal electrodes (hereinafter called "scanning lines (or electrodes)" formed on one substrate and a plurality of data signal electrodes (hereinafter called "data lines (or electrodes)" formed on the other substrate intersect with each other at right angles to provide a pixel at each intersection is used in a liquid crystal display apparatus for displaying, e.g., television images by using a multiplex driving scheme, scanning lines are sequentially selected with skipping of N lines apart (N: positive integer, N=1 in the following case) (hereinafter, referred to as "interlaced scanning").

In this case, alignment states (display states) of liquid crystal molecules at respective pixels for each frame are shown in FIGS. 4A–4D.

Referring to FIGS. 4A–4D, scanning lines 511, 512, 513 . . . formed on one substrate and data lines 521, 522, 523, . . . formed on the other substrate intersect with each to form pixel 530 at each intersection at which liquid crystal molecules are aligned (oriented) in a direction of a short line representing an optical axis direction thereof. In other words, a short line parallel to the data lines shows liquid crystal molecules in an antiferroelectric stable first state (dark state but not shown in FIGS. 4A–4D). Further, a short line tilted rightward shows liquid crystal molecules in a ferroelectric second stable state (bright state) and a short line tilted leftwards shows liquid crystal molecules in a ferroelectric third stable state (bright state).

Herein, the data line direction is taken as a reference direction but the reference directed may be taken in a desired direction. Further, for convenience, the alignment of liquid crystal molecules tilted rightwards is given by application of a voltage of positive polarity (E>0) and the alignment of liquid crystal molecules tilted leftwards is given by application of a voltage of negative polarity (E<0). The tilted states of liquid crystal molecules are determined by a sign and magnitude of spontaneous polarization of a liquid crystal used. Crossed arrows 54 and 55 represent directions of axes of two polarizers (polarizing members), respectively.

In case where all the pixels are placed in a bright state, liquid crystal molecules are all placed in a rightwards tilted alignment state in a certain frame by positive voltage application as shown in FIG. 4A. Then, odd-numbered scanning lines (511, 513 and 515) are subjected to interlaced scanning with a negative voltage (a voltage of a negative polarity) i.e., selected with skipping of one line by scanning in this case, whereby liquid crystal molecules at pixels on the selected odd-numbered scanning lines are tilted leftwards to provide an alignment state as shown in FIG. 4B. Thereafter, even-numbered scanning lines (512, 514 and 516) are subjected to interlaced scanning with a negative voltage, whereby liquid crystal molecules at pixels on the selected even-numbered scanning lines are tilted leftwards to provide an alignment state (a state in which all liquid crystal molecules at all the pixels are tilted leftwards) as shown in FIG. 4C. Then, odd-numbered scanning lines (511, 513 and 515) are subjected to interlaced scanning with a positive voltage, whereby liquid crystal molecules at pixels on the selected odd-numbered scanning lines are tilted rightwards to provide an alignment state as shown in FIG. 4D. Then, even-numbered scanning lines (512, 514 and 516) are subjected to interlaced scanning with a positive voltage, whereby liquid crystal molecules at pixels on the selected even-numbered scanning lines are tilted rightwards to provide the alignment state as shown in FIG. 4A. Accordingly, the alignment state of liquid crystal molecules are changed periodically in every four frames (FIGS. 4A–4D).

However, in the embodiment shown in FIGS. 4A–4D, the alignment state of liquid crystal molecules are largely changed (e.g., from that of FIG. 4A to that of FIG. 4B), particularly when viewed in an oblique direction as described above, so that a frequency of a change in transmittance is lowered depending on a viewing (visual) angle to the above-mentioned display panel, thus causing flickering remarkably.

SUMMARY OF THE INVENTION

Accordingly, a principal object of the present invention is to provide a liquid crystal display apparatus having solved the above-mentioned problem and a method of driving the liquid crystal display apparatus.

A specific object of the present invention is to provide a liquid crystal display apparatus using an antiferroelectric liquid crystal (a ferroelectric liquid crystal assuming three stable states) capable of suppressing an occurrence of flickering caused due to a certain viewing angle to display panel, particularly when viewed in an oblique direction (closer to the side direction).

Another object of the present invention is to provide a method of driving such a liquid crystal display apparatus.

According to a first aspect of the present invention, there is provided a liquid crystal display apparatus, comprising:

a display panel including scanning electrodes and data electrodes intersecting the scanning electrodes so as to form a matrix of pixels each comprising at least two sub-pixels at an intersection of the scanning electrodes and the data electrodes, a ferroelectric liquid crystal disposed between the scanning electrodes and the data electrodes and capable of assuming an antiferroelectric first stable state under application of no voltage and a ferroelectric second stable state and a ferroelectric third stable state under application of voltages corresponding to polarities of the applied voltages, polarizing means for discriminating the first stable state of the liquid crystal as a dark state, and the second and third stable states of the liquid crystal as bright states, and drive means for applying voltages to the scanning electrodes and the data electrodes so as to place the liquid crystal in the second stable state at a sub-pixel of the sub-pixels and in the third stable state at another sub-pixel of the sub-pixels when a pixel concerned is placed in bright state.

According to a second aspect of the present invention, there is provided a liquid crystal display apparatus, comprising:

a display panel including scanning electrodes and data electrodes intersecting the scanning electrodes so as to form a matrix of pixels each at an intersection of the scanning electrodes and the data electrodes, a ferroelectric liquid crystal disposed between the scanning electrodes and the data electrodes and capable of assuming an antiferroelectric first stable state under application of no voltage and a ferroelectric second stable state and a ferroelectric third stable state under application of voltages corresponding to polarities of the applied voltages, polarizing means for discriminating the first stable state of the liquid crystal as a dark state, and the second and third stable states of the liquid crystal as bright states, and drive means for sequentially selecting the scanning electrodes with skipping of N electrodes apart (N: positive integer) by applying selection voltages of polarities alternating for each selection to successively selected scanning electrodes.

The present invention further provides methods of driving the above-mentioned liquid crystal display apparatus according to first and second aspect of the present invention.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The liquid crystal display apparatus according to the first and second aspects of the present invention are driven so as to provide a mixture display state of a ferroelectric second stable state and a ferroelectric third stable state at each pixel or in a prescribed region including plural pixels when a bright state is displayed. The ferroelectric second and third stable states (two bright states) may preferably be alternately switched from each other for each prescribed period (e.g., for each frame).

As a result, in the prescribed region, a difference in transmittance and hue between consecutive frames is substantially suppressed (balanced), thus minimizing an occurrence of flickering to allow high-quality display.

Hereinbelow, the liquid crystal display apparatus of the first aspect of the present invention will be described with reference to FIGS. 5–10.

In the liquid crystal display apparatus according to the first aspect of the present invention, the display apparatus may preferably be driven by using a drive means for applying an image signal, including an alternating signal comprising at least one positive-polarity voltage pulse and at least one negative-polarity voltage pulse, applied to pixels consisting of at least two sub-pixels so that one scanning line is selected by a first selection voltage of one polarity in synchronism with one voltage pulse to determine a stable state (e.g., second stable state) of the liquid crystal at one of sub-pixels (or one group of sub-pixels) and another scanning line is selected by a second selection voltage of the other polarity (a polarity opposite to the first selection voltage) in synchronism with the other voltage pulse to determine a stable state (e.g., third stable state) of the liquid crystal at the other sub-pixel (or the other group of sub-pixels), thus displaying a bright state.

A first embodiment of the liquid crystal display apparatus of the first aspect of the present invention will be described with reference to FIG. 5 and FIGS. 6A and 6B.

Figure 5:
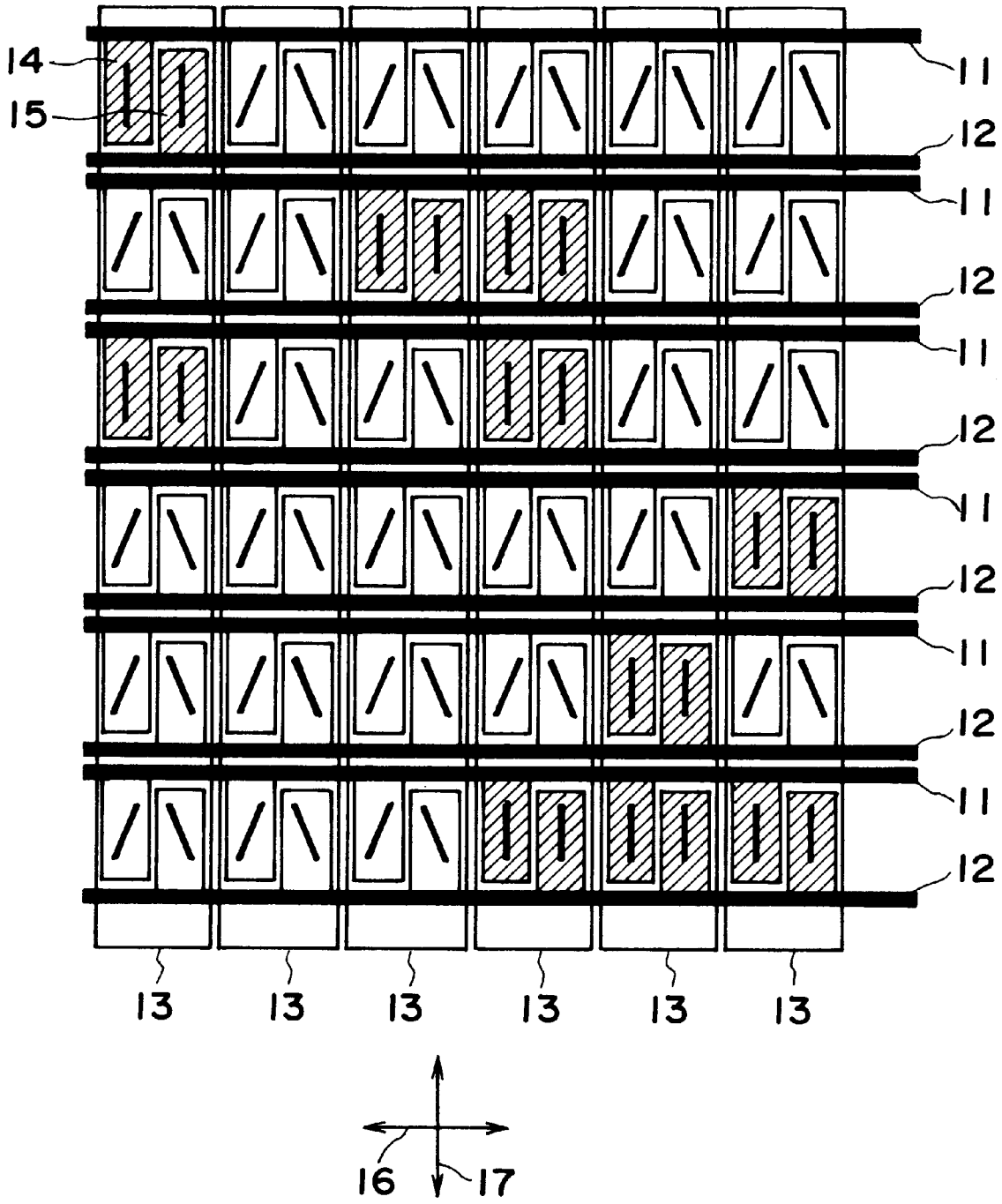
FIG. 5 is an illustration of display states at respective pixels each consisting of two sub-pixels in a first embodiment of a display panel constituting a liquid crystal display apparatus according to the first aspect of the present invention.

FIG. 5 shows a part of a display panel for constituting a liquid crystal display apparatus, including a pair of oppositely disposed substrates and a ferroelectric liquid crystal assuming three stable states (antiferroelectric liquid crystal) disposed between the substrates.

Referring to FIG. 5, scanning lines 11 and 12 and pixel electrodes 14 and 15 (in this embodiment, inclusively referred to as "scanning lines (electrodes)" (are formed on one of the substrates and data lines 13 are formed on the other substrate. The scanning lines 11 are connected with the pixel electrodes 14 and the scanning lines 12 are connected with the pixel electrodes 15. At each intersection of scanning lines and data lines (a portion comprising a pair of pixel electrodes 14 and 15), are pixel consisting of two sub-pixels 14 and 15 is constituted. A short line indicated in each one sub-pixel (14 or 15) represents a direction of an optical axis of liquid crystal molecules, wherein a short line parallel to the data line 13 direction corresponds to an antiferroelectric first stable state (dark state), a short line tilted rightwards from the data line direction corresponds to a ferroelectric second stable state (bright state), and a short line tilted leftwards from the data line direction corresponds to a ferroelectric third stable state (bright state). Reference numerals 16 and 17 represent directions of polarizing axes of a pair of polarizers disposed outside the substrates.

As shown in FIG. 5, when a pixel is placed in a dark state, both of two sub-pixels 14 and 15 (hatched sub-pixels) are in the antiferroelectric first stable state and the optical axis of the ferroelectric liquid crystal is aligned in a direction of the axis 17 of one of the polarizers. When a pixel is placed in a bright state, the sub-pixel (first sub-pixel) 14 connected with the scanning line 11 is in the ferroelectric second stable state represented by the short line tilted rightwards and the sub-pixel (second sub-pixel) 15 connected with the scanning line 15 is in the ferroelectric third stable state represented by the short line tilted leftwards.

In case where the liquid crystal display apparatus of this embodiment is driven by the multiplex driving method wherein a polarity of an applied voltage is inverted for each frame, when the first sub-pixel (sub-pixel 14) is placed in the ferroelectric second stable state and the second sub-pixel (sub-pixel 15) is placed in the ferroelectric third stable state in a certain frame, the first sub-pixel is switched from the second stable state to the third stable state and on the other hand, the second sub-pixel is switched from the third stable state to the second stable state in the following frame.

As described above, according to this embodiment, two sub-pixels are placed in two bright states (ferroelectric second and third stable states) different from each other, whereby a resultant display state at each pixel (consisting of two sub-pixels) becomes a mixture state of two bright states different in transmittance and hue, thus providing an averaged or balanced transmittance and hue for each frame As a result, a difference in transmittance and hue between consecutive frames is suppressed, thus resulting in substantially no flickering.

Figure 6B:
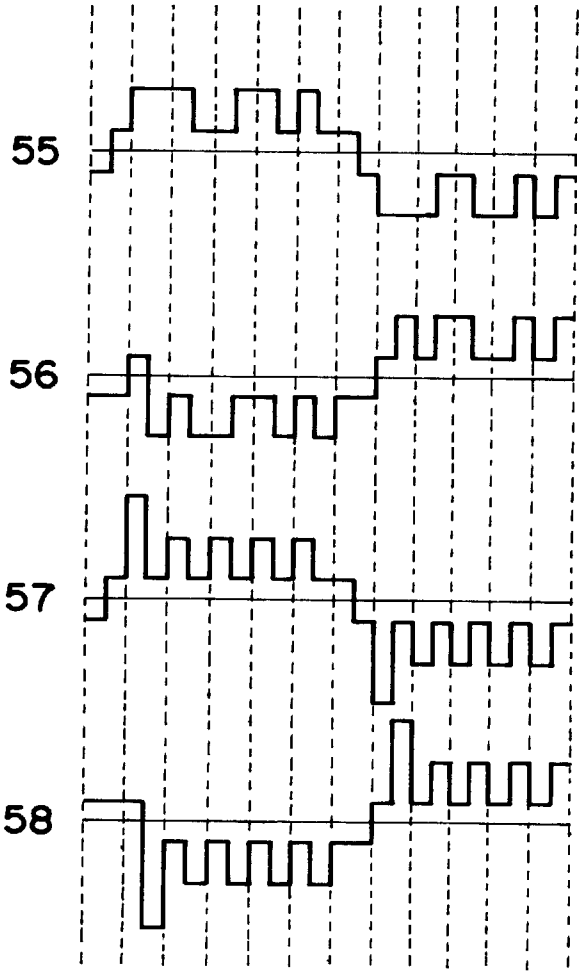
FIGS. 6A and 6B are driving waveform diagrams adopted in the embodiment shown in FIG. 5 including FIG. 6A showing scanning signals 51*a*, 51*b*, 52*a* and 52*b* applied to scanning lines and data signals 53 and 54 applied to data lines, and FIG. 6B showing combined voltage waveforms 55, 56, 57 and 58 applied to corresponding pixels.
Figure 6A:
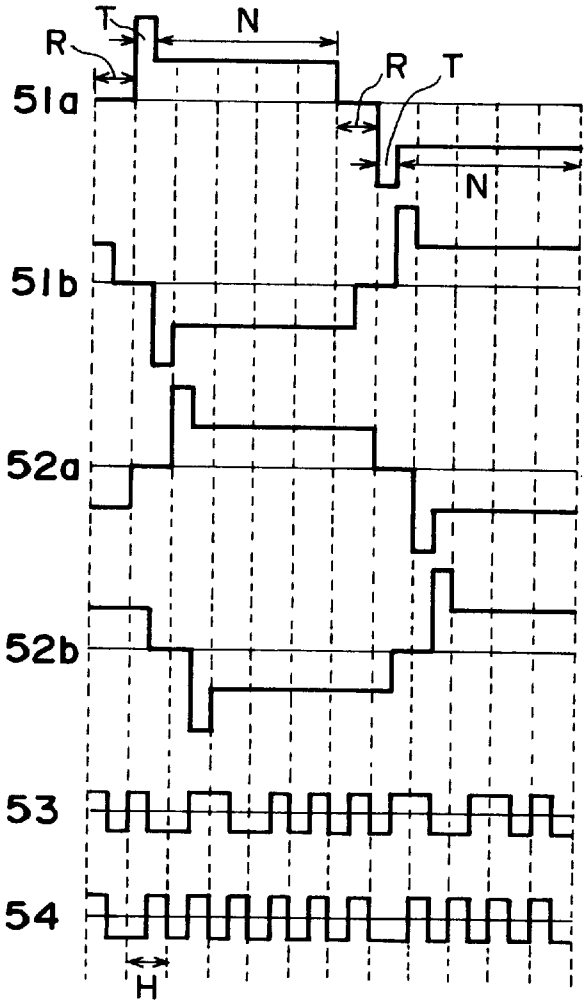

FIGS. 6A and 6B show a set of time-serial drive waveform diagrams used in the embodiment shown in FIG. 5 wherein FIG. 6A shows scanning line application voltages (scanning signals) 51*a,* 51*b,* 52*a* and 52*b* applied to scanning lines 11 (first), 12 (first), 11 (second) and 12 (second), respectively and shows data line application voltages (data signals) 53 and 54 applied to data lines 13, and FIG. 6B shows combined voltages 55–58 (voltages obtained by combination) of the scanning signals 51*a,* 51*b,* 51*a* and 51*b* and the data signals 53, 53, 54 and 54 in this order, respectively (e.g., a combined voltage 55 is obtained by a combination of the scanning signal 51*a* and the data signal 53).

More specifically, the combined voltage 55 (combination of the scanning signal 51*a* and the data signal 53) is applied to a first sub-pixel (e.g., the sub-pixel 14 shown in FIG. 5) connected with the (first) scanning line 11, the combined voltage 56 (combination of the signals 51*b* and 53) is applied to a second sub-pixel (e.g., the sub-pixel 15 as shown in FIG. 5) connected with the (first) scanning line 12, the combined voltage 57 (combination of the signals 51*a* and 54) is applied to another first sub-pixel (e.g., a sub-pixel adjacent to the sub-pixel (the third sub-pixel from the left end in the direction of the (first) scanning lines 11 and 12) 14 via the sub-pixel 15 shown in FIG. 5) connected with the (first) scanning line 11, and the combined voltage 58 (combination of the signals 51*b* and 54) is applied to another second sub-pixel (e.g., a sub-pixel adjacent to the above third sub-pixel, i.e., the fourth sub-pixel) connected to the (first) scanning lines.

Each of the scanning signals 51*a,* 51*b,* 52*a* and 52*b* has a signal voltage waveform comprising a selection period (T) with application of a selection voltage, a reset period (R) with no voltage application immediately before the selection period (T), and a non-selection period (N) with application of a bias voltage (DC voltage) immediately after the selection period (T) as shown in FIG. 6A. In the reset period (R), all the sub-pixels on the associated scanning line are placed in (resetted into) a dark state under no voltage application. In the selection period (T), the selected sub-pixels are changed from the dark state to either one of two bright states by applying the selection voltage. Further, in the non-selection period (N), the selected sub-pixels are retained in the bright state by applying the bias voltage.

The first scanning line 11 connected with the first sub-pixel group and the second scanning line 12 connected with the second sub-pixel group are sequentially selected in one unit period (H) of an image signal (e.g., data signal 54) as shown in FIG. 6A.

In the embodiment shown in FIG. 5, for example, the scanning lines 11 are supplied with a first selection voltage of positive polarity in the corresponding selection period (T) and the scanning lines 12 are supplied with a second selection voltage of negative polarity in the corresponding selection period (T) in odd-numbered frames as shown in FIG. 6A. In synchronism therewith, the data lines 13 are supplied with an alternating signal voltage (as image signal) comprising at least one positive-polarity voltage pulse and at least one negative-polarity voltage pulse (positive/negative alternating signal voltage), e.g., represented by the data signal 53 shown in FIG. 6A or supplied with another alternating signal voltage (negative/positive alternating signal voltage), e.g., represented by the data signal 54 shown in FIG. 6A. In the case of using the positive/negative alternating signal voltage (data signal 53), voltages combined with the scanning signals (51*a,* 51*b*) applied to the first and second sub-pixel groups are below a threshold voltage as represented by the combined voltages 55 and 56 shown in FIG. 6B, thus retaining a dark state immediately before the voltage application. On the other hand, in the case of using the negative/positive alternating signal voltage (data signal 54), voltages combined with the scanning signals (51*a,* 51*b*) applied to the first and second sub-pixel groups are equal to or exceeds a threshold voltage as represented by the combined voltages 57 and 58 shown in FIG. 6B, whereby the first sub-pixel group supplied with the combined voltages 57 is placed in one of the bright state (ferroelectric second stable state) and the second sub-pixel group supplied with the combined voltage 58 is placed in the other bright state (ferroelectric third stable state). Thereafter, the above operation is repeated for each two consecutive scanning lines (connected with associated first and second sub-pixel groups) to complete scanning of one frame.

On the other hand, in even-numbered frames, the polarities of the scanning signals and data signals are inverted (changed) to the other polarity (polarities opposite to those in the case of the odd-numbered frames), so that the first and second sub-pixel groups are supplied with combined voltages of polarities opposite to those in the case of the odd-numbered frames, thus resulting in inversion between two bright states (second and third stable states) to provide the first and second sub-pixel groups with the other bright state, respectively, different from those in the case of the odd-numbered frames.

Then, a second embodiment of the liquid crystal display apparatus according to the second aspect of the present invention will be described hereinbelow.

Figure 7:
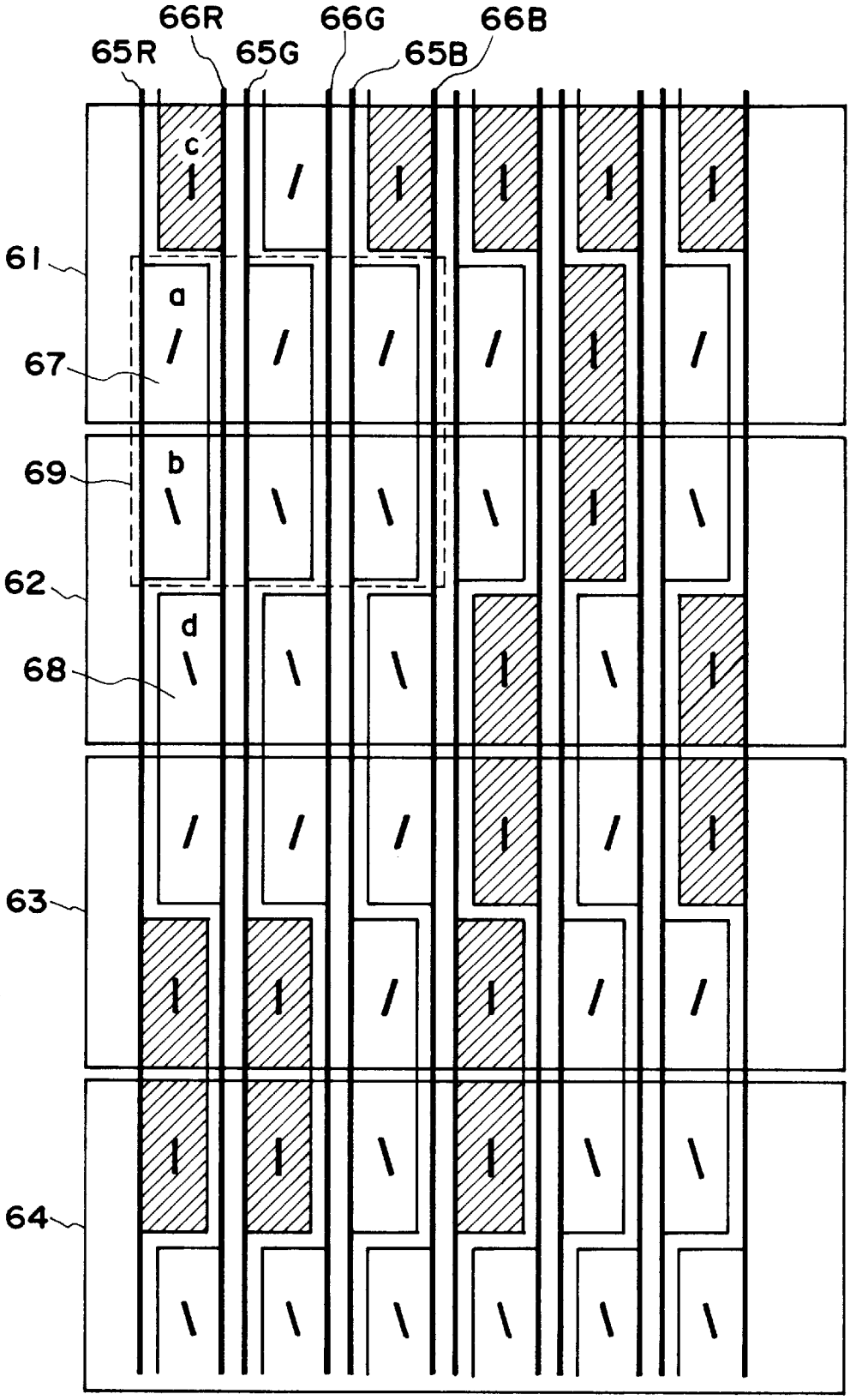
FIG. 7 is an illustration of display states at respective pixels each consisting of six sub-pixels in a second embodiment of a display panel constituting a liquid crystal display apparatus according to the first aspect of the present invention.

FIG. 7 shows a part of a display panel for constituting a liquid crystal display apparatus, including a pair of oppositely disposed substrates and a ferroelectric liquid crystal assuming three stable states disposed between the substrates.

Referring to FIG. 7, scanning lines 61–64 are formed on one of the substrates, and data lines 65R<66R, 65G, 66G, 65B and 66B and pixel electrodes 67 and 68 (in this embodiment, inclusively referred to as "data line (electrodes)") are formed on the other substrate. One pixel (surrounded by dotted (broken) lines) is divided into three color regions of R (red), G (green) and B (blue) corresponding to a color filter comprising three color filter segments of R, G and B, respectively, and further divided in two portions (e.g., a and b) by two consecutive (adjacent) scanning lines (e.g., the scanning liens 61 and 62), thus being constituted by six sub-pixels. Each of the pixel electrode (e.g., 67) includes two sub-pixels (e.g., a sub-pixel a and a sub-pixel b). Six sub-pixels constituting one pixel (prescribed pixel) are defined by three consecutive data lines 65R, 65G and 65B and two consecutive scanning lines 61 and 62 and driven by applying a voltage to these lines. Pixels adjacent to the above described pixel in the data line direction are defined by different three consecutive data lines 66R, 66G and 66G and two consecutive scanning line (e.g., the scanning lines 62 and 63 for the pixel under the prescribed pixel) and driven by applying a voltage to these lines.

Figure 8B:
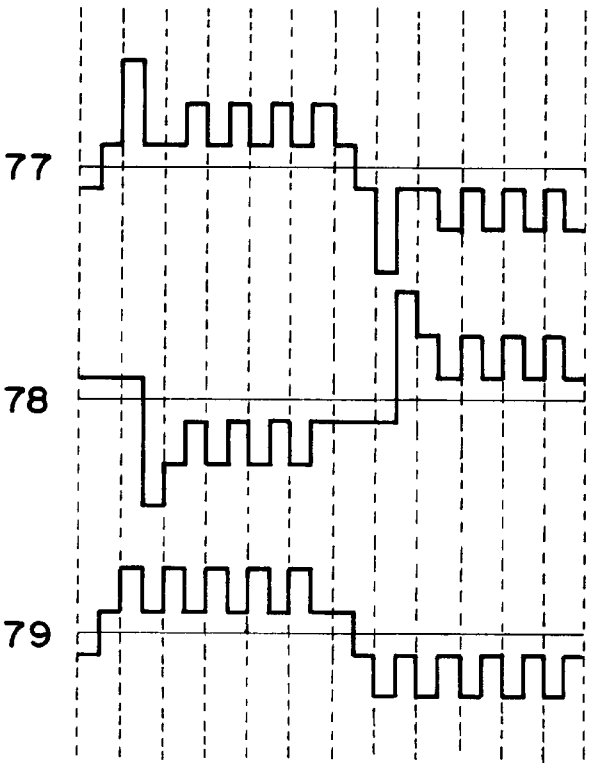
FIGS. 8A and 8B are driving waveform diagrams adopted in the embodiment shown in FIG. 7 including FIG. 8A showing scanning signals 71–74 applied to scanning lines and data signals 75R and 76R applied to data lines, and FIG. 8B showing combined voltage waveforms 77–79 applied to corresponding pixels.
Figure 8A:
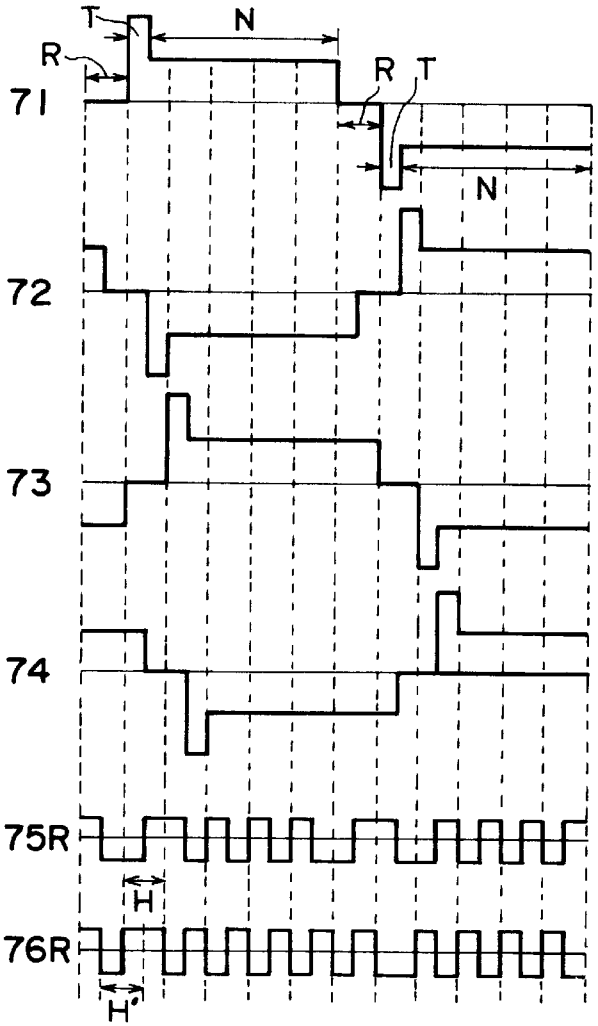

FIGS. 8A and 8B show a set of time-serial drive waveform diagrams used in the embodiment shown in FIG. 7 wherein FIG. 8A shows scanning line application voltages (scanning signals) 71–74 applied to scanning lines 61–64, respectively and shows data line application voltages (data signals) 75R and 76R applied to data lines 65R and 66R, and FIG. 8B shows combined voltages 77–79 (voltages obtained by combination) of the scanning signals and the data signals, wherein the combined voltage 77 is obtained by a combination of the scanning signal 71 and data signal 75R and applied to the sub-pixel a shown in FIG. 7, the combined voltage 78 is obtained by a combination of the scanning signal 72 and data signal 75R and applied to the sub-pixel b shown in FIG. 7, and the combined voltage 79 is obtained by a combination of the scanning signal 71 and data signal 76R and applied to the sub-pixel c (in hatched dark state) shown in FIG. 7.

Each of the scanning signals 61–64 has a signal voltage waveform comprising a selection period (T) with application of a selection voltage, a reset period (R) with no voltage application immediately before the selection period (T), and a non-selection period (N) with application of a bias voltage (DC voltage) immediately after the selection period (T) as shown in FIG. 8A (similarly as in those shown in FIG. 6A described above). In the reset period (R), all the sub-pixels on the associated scanning line are placed in (resetted into) a dark state under no voltage application. In the selection period (T), the selected sub-pixels are changed from the dark state to either one of two bright states by applying the selection voltage. Further, in the non-selection period (N), the selected sub-pixels are retained in the bright state by applying the bias voltage similarly as in the embodiment of FIG. 5 described above.

The scanning lines 61–64 (shown in FIG. 8A) are selected by applying the scanning signals 71–74, respectively, while alternately inverting the polarity of the applied voltage for each scanning signal. In the embodiment shown in FIG. 7, a positive-polarity selection voltage is supplied to the scanning line 61 in the selection period (T) of the scanning signal 71 and then a negative-polarity selection voltage is supplied to the subsequent scanning line 62 in the selection period (T) of the scanning signal 72. In one unit period (H) synchronized with these selection period (T) (of the scanning signals 71 and 72), when an alternating signal voltage (as image signal) including at least one negative-polarity voltage pulse and at least one positive-polarity voltage pulse as shown in the data signal 75R is applied to the data line 65R (shown in FIG. 7), the sub-pixels a and b (pixel electrode 67) are supplied with positive and negative voltages, respectively, each exceeding a threshold voltage value to provide a type of different bright states (second and third stable states) indicated by oppositely tilted short lines as shown in FIG. 7, respectively. In the case of providing (writing) a dark state, an opposite alternating signal voltage (positive/negative) is applied to the data line 65R.

Further, by applying another (preceding) alternating signal voltage (data signal) 76R to he data line 66R in one unit period (H') (shown in FIG. 8A) in synchronism signal 71 and selection period of the preceding scanning signal (not shown) applied to a scanning line immediately before the scanning line 61, a display state of one pixel electrode including the sub-pixel c is determined. In synchronism with the selection period (T) of the scanning signal 72 (applied to the scanning line 62) and a selection period of the scanning signal 73 (applied to the scanning line 63), a subsequent alternating signal of the data signal 76R is applied to the data line 66R to determine a display state of the pixel electrode 68 including the sub-pixel d (shown in FIG. 7). Thus, the data lines 65R and 66R are supplied with alternating color image (R: red) signals (data signals 75R and 76R) in one unit period (H) and (another) one unit period (H'), respectively, with a difference in scanning period therebetween of ½ unit period (½H or ½H').

Similarly, other data line 65G, 66G, 65B and 66B are supplied with corresponding alternating color image signals (data signals) for G (green), G (green), B (blue) and B (blue), respectively.

As described above, prescribed scanning lines are sequentially selected to display images on one picture area, thus completing scanning of one frame. Then, scanning is similarly performed in a subsequent frame by applying voltage signals each of a (different) polarity opposite to the polarity of the applied voltage in the above scanning operation.

In the second embodiment shown in FIG. 7, two sub-pixel groups are driven by using different (two consecutive) scanning lines similarly as in the first embodiment shown in FIG. 5.

However, in the second embodiment (FIG. 7), different from the first embodiment (FIG. 5), adjacent to sub-pixels (e.g., the sub-pixels b and d) assigned to different pixels in the data line direction are provided together on one scanning line (e.g., the scanning line 62). As a result, compared with the first embodiment (FIG. 5), the number of scanning lines and scanning time become half thereof but the number of data lines doubles.

As described above, according to the liquid crystal display apparatus of the first aspect of the present invention, each of pixels on a display panel is constituted by at least two sub-pixels including one sub-pixel (group) placed in the second stable state and the other sub-pixel (group) placed in the third stable state when a pixel concerned is placed in a bright state by using a drive means (voltage application means), whereby flickering of a resultant image can be minimized and differences in transmittance and hue when viewed in an oblique direction, thus improving a viewing angle characteristic as a whole.

Hereinbelow, the liquid crystal display apparatus according to the second aspect of the present invention will be described with reference to FIGS. 9 (9A–9D) and 10.

The liquid crystal display apparatus of the second aspect the present invention is characterized by a combination of the second and third ferroelectric stable states when pixels (including a ferroelectric crystal assuming three stable states) are driven for displaying bright state by using interlaced scanning (wherein scanning lines are sequentially selected with skipping of N lines (N: positive integer) by scanning). In this instance, N may be an odd number or an even number, preferably an odd number, more preferably 1, in view of alleviation of flickering by suppressing a change in alignment state of liquid crystal molecules for each frame to provide a uniform display state.

FIGS. 9A–9D each show a part of a display panel for constituting a liquid crystal display apparatus, including a pair of oppositely disposed substrates and a ferroelectric liquid crystal assuming three stable states (antiferroelectric liquid crystal) disposed between the substrates.

Referring to FIGS. 9A–9D, scanning lines 111–116 formed on one substrate and data lines 121–126 formed on the other substrate intersect with each other to form a pixel at each intersection at which liquid crystal molecules are tilted in a direction of a short line representing an optical axis 110 thereof similarly as in these shown in FIGS. 4A–4D. Outside the display panel, a pair of polarizers (polarizing members) having axes 140 and 150 are disposed, respectively.

Figure 9A:
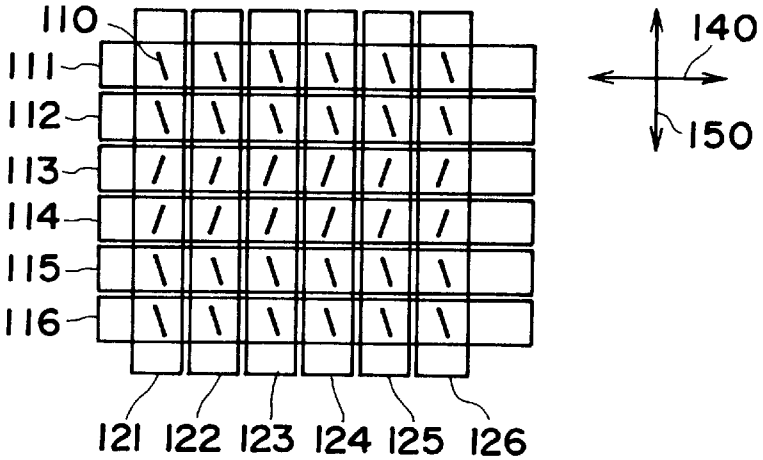
FIGS. 9A–9D are illustrations of display states at respective pixels in an embodiment of a liquid crystal display apparatus driven by using interlaced scanning according to the second aspect of the present invention, including FIG. 9A showing a display state in a certain (first) frame, FIG. 9B showing a display state in a second frame, FIG. 9C showing a display state in a third frame, and FIG. 9D showing a display state in a fourth frame.

FIG. 9A shows an initial display state (alignment state) in a first frame wherein all the pixels are placed in two bright states in mixture.

Figure 9B:
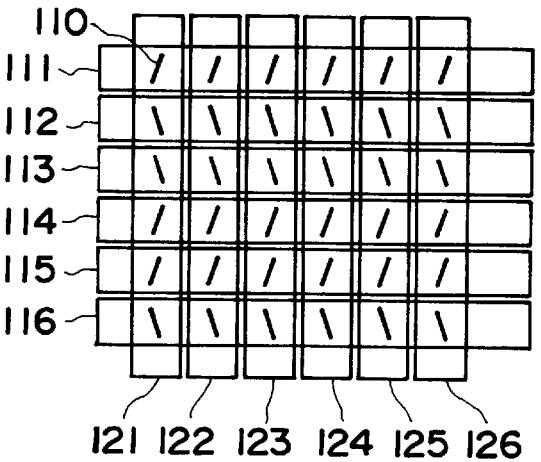

When odd-numbered scanning lines are subjected to interlaced scanning (i.e., selected with skipping of one line) so that a first group of odd-numbered scanning lines of 1st, 5th, 9th, 13th, lines (4k+1, k=integer) are supplied sequentially with a positive-polarity voltage (i.e., selected with skipping of three lines (2nd, 3rd and 4th lines) by scanning) and a second group of odd-numbered scanning lines of 3rd, 7th, 11th, 15th, . . . lines (4k+3) are sequentially supplied with a negative-polarity voltage in a subsequent (second) frame, a resultant display state in the second frame is shown in FIG. 9B.

Figure 9C:
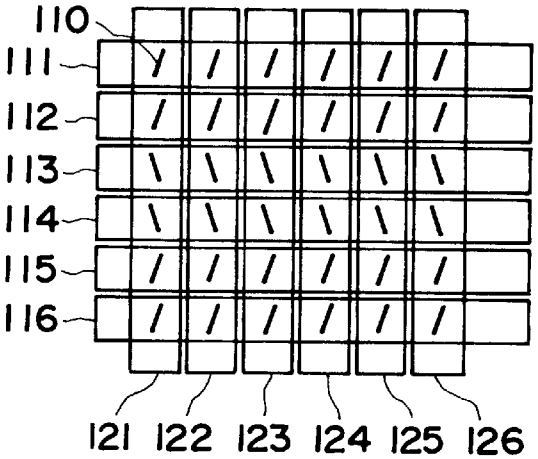

Then, when even-numbered scanning lines are subjected to interlaced scanning so that a first group of even-numbered scanning lines of 2nd, 6th, 10th, 14th, . . . lines (4k+2) are sequentially supplied with a positive-polarity voltage and a second group of even-numbered scanning lines of 4th, 8th, 12th, 18th, . . . lines (4k) are sequentially supplied with a negative-polarity voltage in a subsequent (third) frame, a resultant display state in the third frame is shown in FIG. 9C.

Figure 9D:
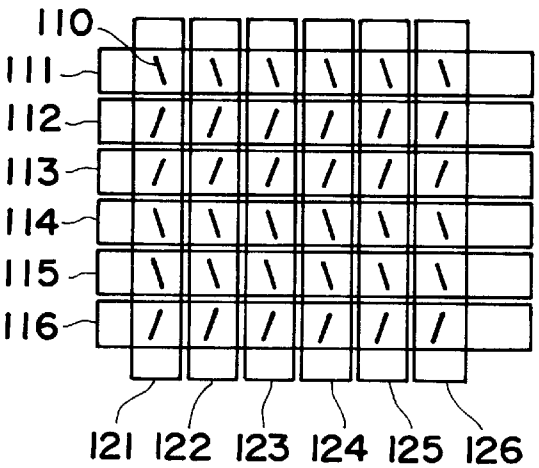

Thereafter, when odd-numbered scanning lines are subjected to interlaced scanning with opposite-polarity voltages to those used in the first frame so that a first group of odd-numbered scanning lines of 1st, 5th, 9th, 13th, . . . lines (4k+l, k=integer) are supplied sequentially with a negative-polarity voltage (i.e., selected with skipping of three lines (2nd, 3rd and 4th lines) by scanning) and a second group of odd-numbered scanning lines of 3rd, 7th, 11th, 15th, . . . lines (4k+3) are sequentially supplied with a positive-polarity voltage in a subsequent (fourth) frame, a resultant display state in the second frame is shown in FIG. 9D.

Then, when even-numbered scanning lines are subjected to interlaced scanning with opposite-polarity voltages to those used in the second frame so that a first group of even-numbered scanning lines of 2nd, 6th, 10th, 14th, . . . lines (4k+2) are sequentially supplied with a negative-polarity voltage and a second group of even-numbered scanning lines of 4th, 8th, 12th, 18th, . . . lines (4k) are sequentially supplied with a positive-polarity voltage in a subsequent (fifth) frame, a resultant display state in the fifth frame is shown in FIG. 9A, i.e., returned to the display state in the first frame.

Thereafter, the above-mentioned interlaced scanning scheme (operation) is repeated.

In this embodiment (FIGS. 9A–9D), the display state is changed periodically in every four frames similarly as in the embodiment shown in FIGS. 4A–4D, i.e., one display cycle is constituted by four frames. However, when compared with the embodiment of FIGS. 4A–4D, the embodiment of FIGS. 9A–9D is excellent in a mixture state of two bright states (represented by short lines tilted rightwards and leftwards, respectively) since, on each one data line (e.g., the data line 121) in each frame, a molecular alignment is such that liquid crystal molecules tilted rightwards and those tilted leftwards are aligned alternately every two scanning lines, thus balancing transmittance and hue so as not to be mutually distinguished by eyes between two consecutive frames.

Figures 1A, 1B, 1C:
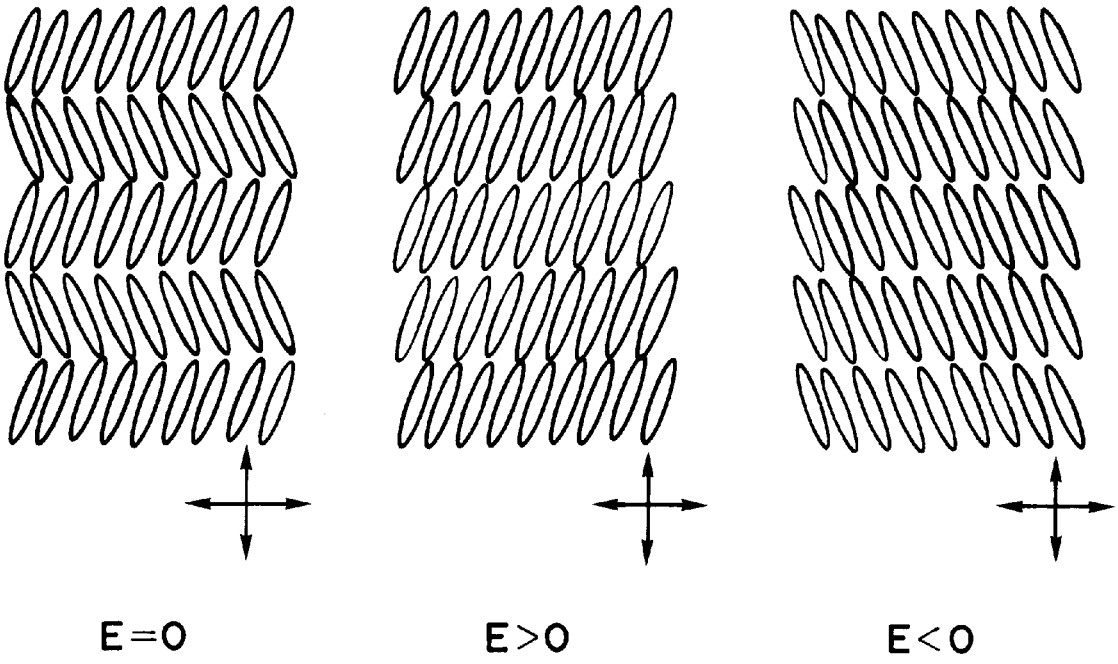
FIGS. 1A–1C illustrate three optically stable states of a ferroelectric liquid crystal used in the invention, including FIG. 1A showing an alignment of liquid crystal molecules in an antiferroelectric first stable state (dark state), FIG. 1B showing an alignment of liquid crystal molecules in a ferroelectric second stable state (bright state), and FIG. 1C showing an alignment of liquid crystal molecules in a ferroelectric third stable state (bright state).
Figure 2:
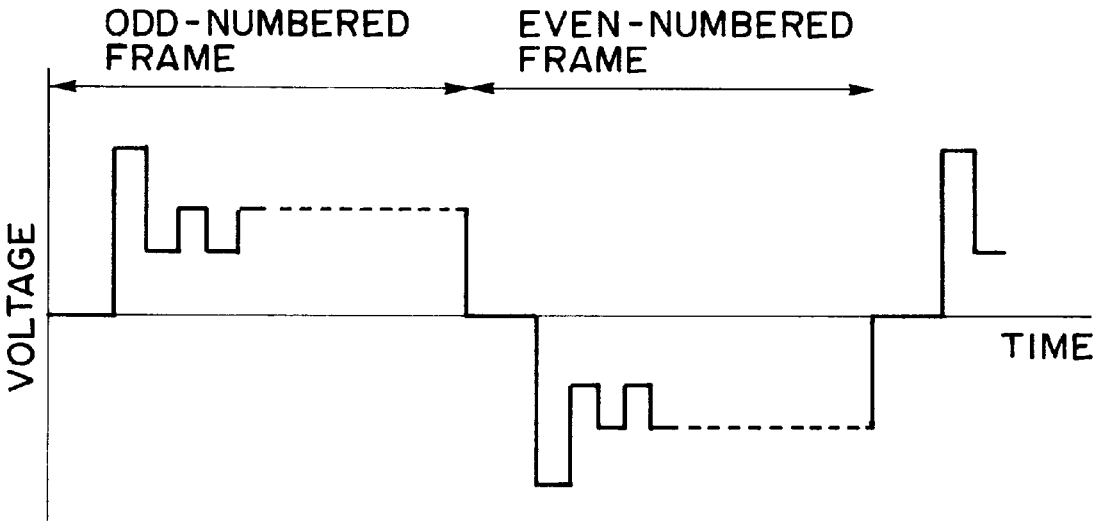
FIG. 2 is a diagram for illustrating a voltage waveform applied to a pixel in the polarity-inversion drive method.
Figure 3A:
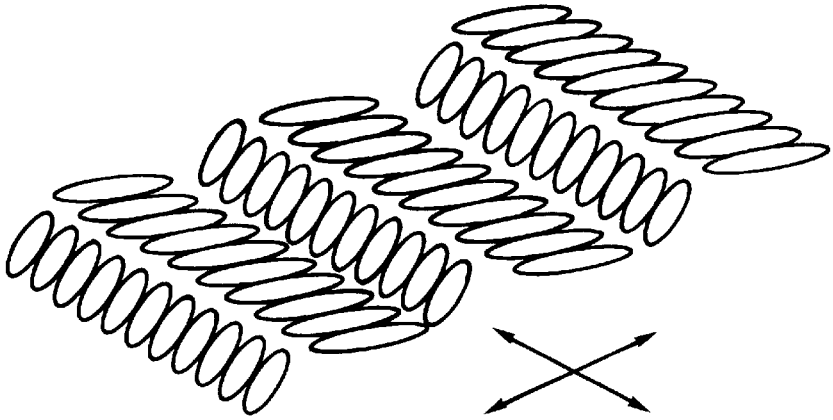
FIGS. 3A–3C are views in three optically stable states of a ferroelectric liquid crystal viewed in an oblique direction, including FIG. 3A showing an alignment of liquid crystal molecules in a dark state, FIG. 3B showing an alignment of liquid crystal molecules in a bright state, and FIG. 3C showing an alignment of liquid crystal molecules in a bright state corresponding to those shown in FIGS. 1A–1C, respectively.
Figure 3B:
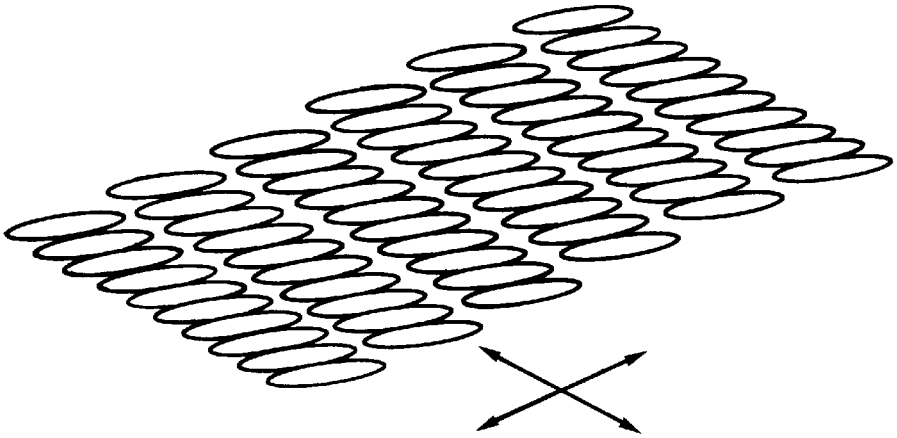
Figure 3C:
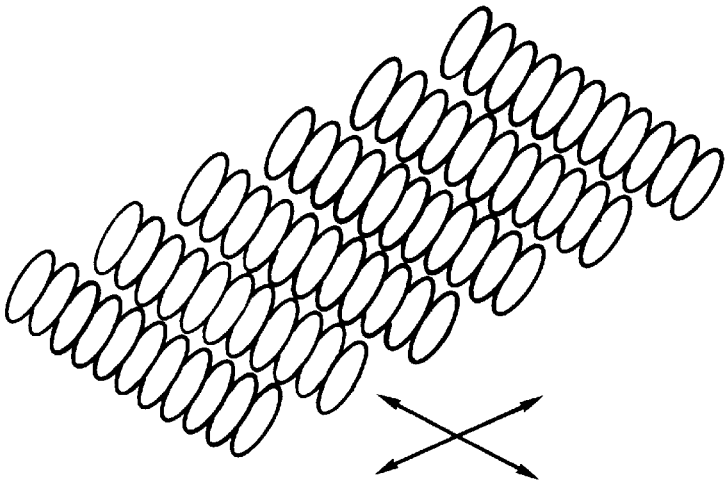
Figure 4A:
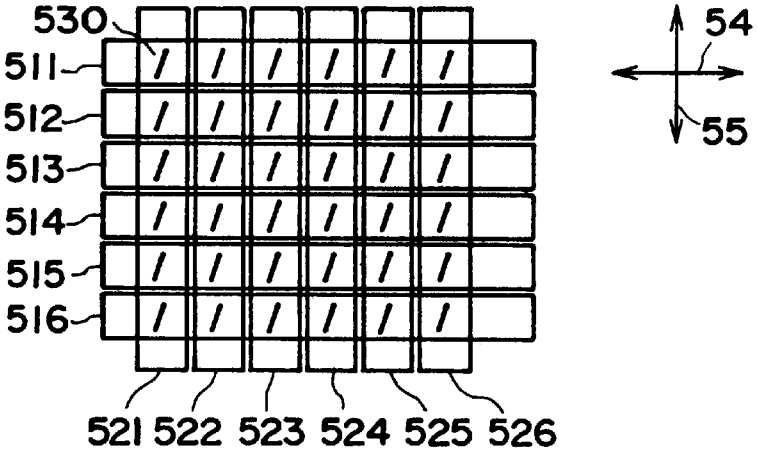
FIG. 4A PRIOR ART
FIGS. 4A–4D are illustrations of display states of respective pixels in an embodiment of an ordinary liquid crystal display apparatus driven by using interlaced scanning, including FIG. 4A showing a display state in a certain (first) frame, FIG. 4B showing a display state in a second frame, FIG. 4C showing a display state in a third frame, and FIG. 4D showing a display state in a fourth frame.
Figure 4B:
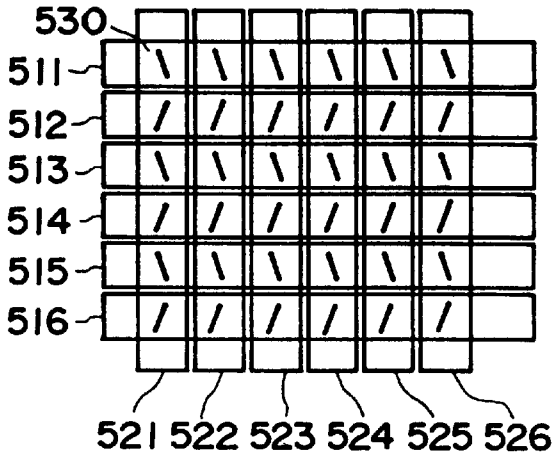
FIG. 4B PRIOR ART
Figure 4C:
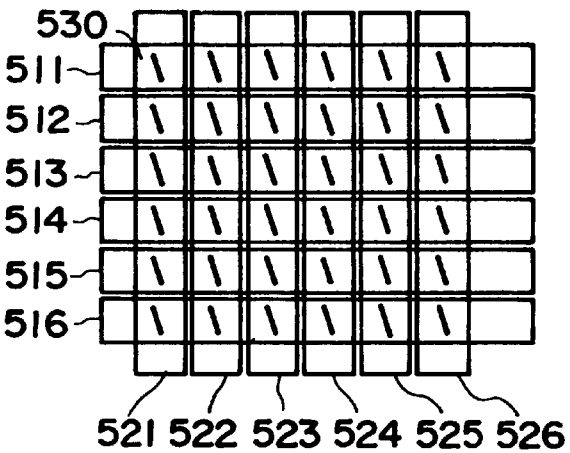
FIG. 4C PRIOR ART
Figure 4D:
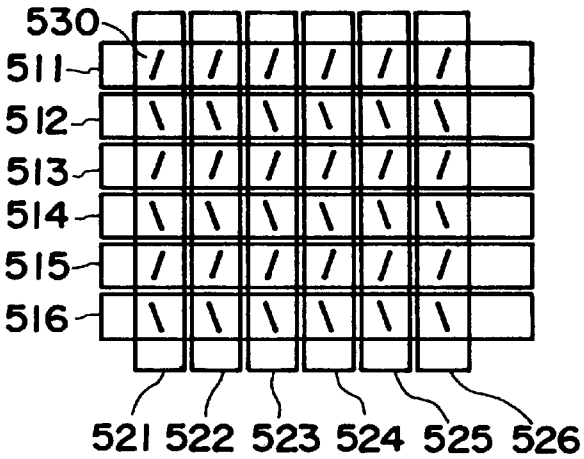
FIG. 4D PRIOR ART

Further, as understood from the molecular alignments shown in FIGS. 9A–9D, a difference in molecular alignment between two consecutive frames (1st and 2nd frames (FIGS. 9A and 9B), 2nd and 3rd frames (FIGS. 9B and 9C), 3rd and 4th frames (FIGS. 9C and 9D, and 4th and 5th (1th) frames (FIGS. 9D and 9A), respectively) is minimized since the molecular alignment in a certain frame (e.g., 1st frame shown in FIG. 9A) is identical to that in a subsequent frame (e.g., 2nd frame shown in FIG. 9B) if a part of the molecular alignment on the first scanning line 111 (in this case, that of FIG. 9B) is omitted, i.e., the molecular alignment on the scanning lines 111–115 in the certain frame is identical to that on the scanning lines 112–116 in the subsequent frame. As a result, the difference in molecular alignment in this embodiment (FIGS. 9A–9D) is balanced not to be confirmed by eyes, thus resulting in a substantially identical molecular alignment to remarkably alleviate a degree of flickering compared with the embodiment shown in FIGS. 4A–4D.

Figure 10:
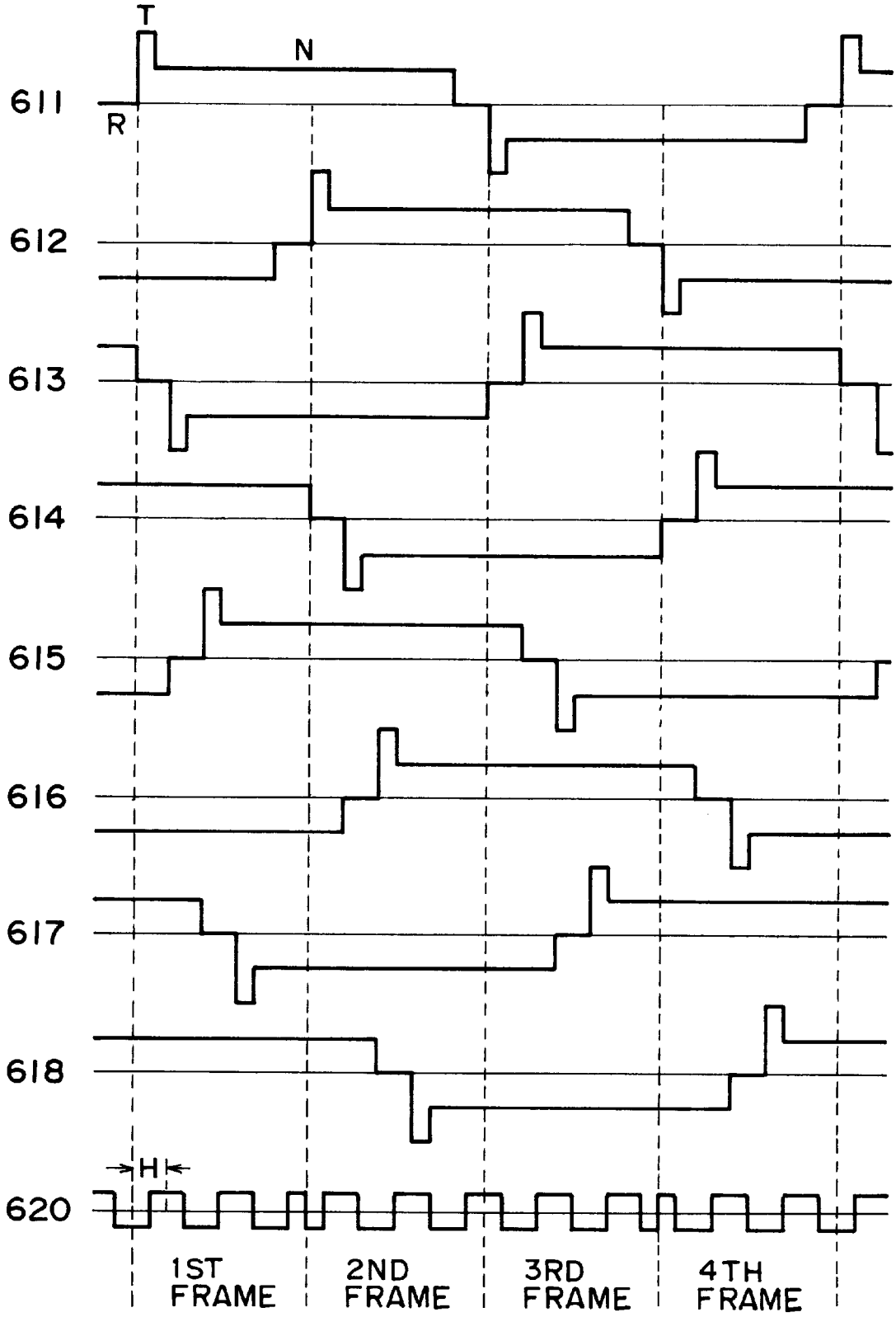
FIG. 10 shows a driving waveform diagram adopted in the embodiment shown in FIGS. 9A–9D including scanning signals 611–618 applied to scanning lines and a data signal 620 applied to data lines.

FIG. 10 shows a set of time-serial drive waveform diagram for providing the display states shown in FIGS. 9A–9D, including scanning line application voltages (scanning signals) 611–618 applied to the scanning lines and a data line application voltage (data (or image) signal) 620 applied to the data lines.

Each of the scanning signals 611–618 has a signal voltage waveform comprising a selection period (T) with application of a selection voltage, a reset period (R) with no voltage application immediately before the selection period (T), and a non-selection period (N) with application of a bias voltage (DC voltage) immediately after the selection period (T) as shown in FIG. 10 (similarly as in those shown in FIG. 6A described above). In the reset period (R), all the pixels on the associated scanning line are placed in (resetted into) a dark state under no voltage application. In the selection period (T), the selected pixels are changed from the dark state to either one of two bright states by applying the selection voltage. Further, in the non-selection period (N), the selected pixels are retained in the bright state by applying the bias voltage similarly as in the embodiment of FIG. 5 described above.

Referring to FIG. 10, in the first frame and third frame, only the odd-numbered scanning lines (e.g., the scanning lines 111, 113, 115, . . . as shown in FIGS. 9A and 9C) are sequentially selected by applying voltages (scanning signals) 611, 613, 615 and 617 to provide the display states as shown in FIGS. 9B and 9D, respectively. On the other hand, in the second frame and fourth frame, only the even-numbered scanning lines (e.g., the scanning lines 112, 114, 116, . . . as shown in FIGS. 9B and 9D) are sequentially selected by applying voltages (scanning signals) 612, 614, 616 and 618 to provide display the states as shown in FIGS. 9C and 9A, respectively. Thus, in each of the frames, the polarities of the selection voltages applied to the selected scanning line are inverted for each selected scanning line a shown in FIG. 10. Specifically, e.g., in the first frame; the scanning signal 611 applied to a first selected scanning line 111 has a positive polarity, the scanning signal 613 applied to a third selected scanning line 113 has a negative polarity, and the scanning signal 615 applied to a fifth selected scanning line 115 has a positive polarity. Further, each of the scanning line (e.g., the scanning line 111) is supplied with the corresponding scanning signal (e.g., the scanning signal 611) of a polarity which is inverted for each prescribed period wherein the scanning line is selected.

In FIG. 10, the data signal (image signal) 620 includes one horizontal scanning period (H) wherein if a combined voltage with the corresponding scanning signal selection voltage exceeds a threshold voltage value, the pixel concerned is placed in the corresponding bright state (second or third ferroelectric stable state). The data signal 620 is used for providing all the pixels with either one of the bright states. In the case of providing a dark state, a data signal having the polarities opposite to those of the data signal 620 in respective one horizontal scanning periods (H).

As described above, according to the liquid crystal display apparatus of the second aspect of the present invention, scanning lines are sequentially selected according to scanning with skipping of N lines (N: positive integer) (i.e., subjected to interlaced scanning) by using a drive means (voltage application means) while alternately inverting the polarity of the applied (selection) voltage applied to the liquid crystal (or pixels) in each one horizontal scanning period, whereby flickering of a resultant image placed in bright state in a prescribed display region can be minimized and differences in transmittance and hue particularly when viewed in an oblique direction, thus improving a viewing angle characteristic as a whole.

Hereinbelow, the ferroelectric liquid crystal assuming three stable states (antiferroelectric liquid crystal) used in the present invention will be described.

As described hereinabove, such a ferroelectric liquid crystal is placed in an antiferroelectric first stable state (dark state) under no voltage (electric field) application and placed in a ferroelectric second or third stable state (bright state) under voltage application depending on a polarity (positive or negative) of the applied voltage.

Examples of such a ferroelectric liquid crystal may include those represented by the following formulae (1)–(10) together with their phase transition temperatures.

(1)

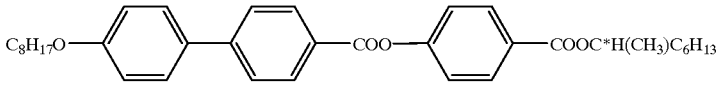

Cry 72.5 $SmC_A^*$ 117 SmC* 121.5 SmA 149.6 Iso (°C.)

(2)

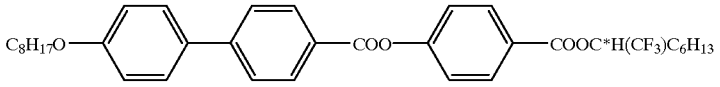

Cry 74 $SmC_A^*$ 114 SmC* 115 SmA 123 Iso (°C.)

(3)

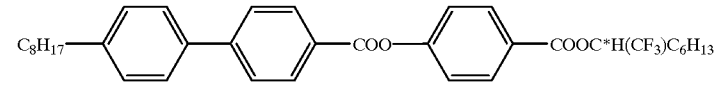

Cry 24.5 $SmC_A^*$ 74 SmC* 75.4 SmA 79.2 Iso (°C.)

(4)

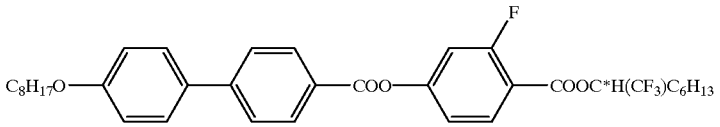

Cry -2 $SmC_A^*$ 110 SmA* 112 Iso (°C.)

(5)

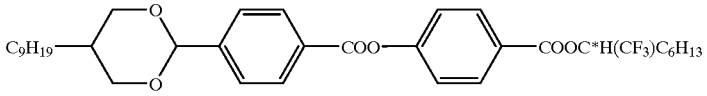

Cry 18 $SmC_A^*$ 70.4 SmC* 71.5 SmA 79.9 Iso (°C.)

(6)

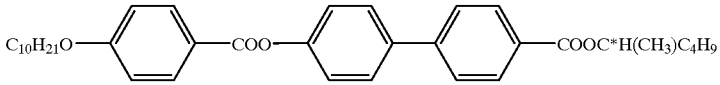

Cry 48 $SmC_A^*$ 73 $SmC_\tau^*$ 86 SmC* 106 SmA 134 Iso (°C.)

-continued (7)

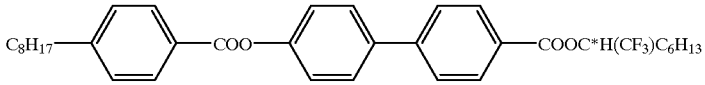

Cry -20 $SmC_A$* 38 SmC* 40 SmA 61.9 Iso (°C.)

(8)

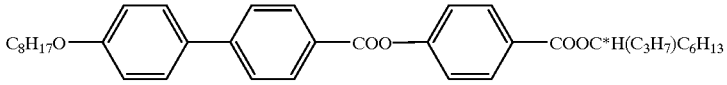

Cry 39.2 $SmC_A$* 87.0 SmA 103.2 Iso (°C.)

(9)

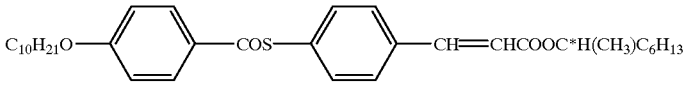

Cry 11 $SmC_A$* 31 SmX 53 SmA 72 Iso (°C.)

(10)

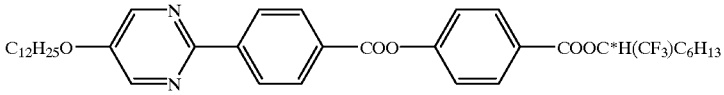

Cry 32 $SmC_A$* 97.0 SmA 104.0 Iso (°C.)

In the above-indicated phase transition data expressions, Cry denotes a crystal phase; SmA, smectic A phase; SmX, a smectic phase (un-identified); and Iso, isotropic phase. Further, $SmC_A$*, SmCr* and SmC* all represent chiral smectic phases, including $SmC_A$* representing a phase capable of providing a ferroelectric state and an anti-ferroelectric state, SmC* representing a phase providing only a ferroelectric state, and SmCr* representing a chiral smectic phase (further un-identified), respectively when placed in a non-helical state by suppressing the occurrence of a helical alignment state inherent to the chiral smectic phase.

Hereinbelow, the display panel used in the liquid crystal display apparatus according to the present invention will be described with reference to FIGS. 11 and 12.

Figure 11:
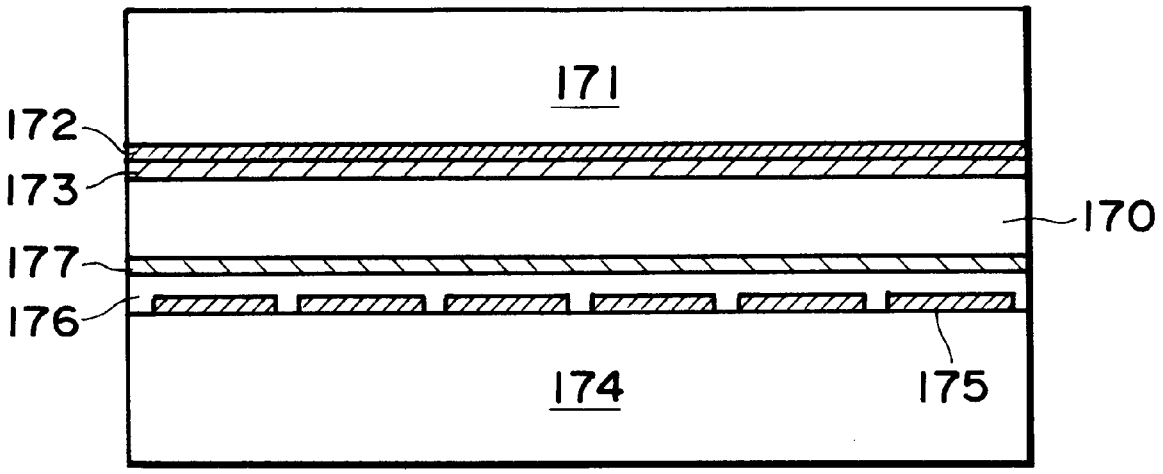
FIG. 11 is a schematic sectional view of an embodiment of a display panel used in a liquid crystal display apparatus according to the first and second aspect of the present invention.

FIG. 11 is a schematic sectional view of an embodiment of a display panel applicable to the liquid crystal display apparatus according to the first and second aspects of the present invention.

Referring to FIG. 11, the display panel includes a pair of transparent substrates 171 and 174 oppositely disposed and provided with electrodes and includes a ferroelectric liquid crystal 170 assuming three stable states disposed between the substrates 171 and 174 with a prescribed spacing or cell gap (e.g., 2.5 $\mu$m).

On one of the substrate 171, scanning electrodes (scanning lines) 172 are formed, and thereon, an alignment control layer 173, e.g., composed of a 5 nm-thick nylon film subjected to rubbing is formed. The nylon film can be replaced with a polyimide film.

On the other substrate 174, data electrodes (data lines) 175 are formed, and thereon a mixture film 176 of, e.g., $SiO_2$ and $ZrO_2$ for preventing short circuit between the substrates. The mixture film 176 is coated with a surface treatment layer 177 comprising siloxane in a thickness of at most 10 nm.

The surface treatment layer 177 is not subjected to rubbing and accordingly has a smaller surface energy than the opposite alignment control layer (rubbing-treated layer) 173, thus having a weak (small) homogenous alignment-imparting force to the liquid crystal. For this reason, when the liquid crystal is once heated to isotropic phase and then cooled to smectic phase for alignment (orientation) of liquid crystal molecules, the formations of direction order and smectic layer order occur preferentially from the rubbing-treated layer 173 side, thus suppressing an occurrence of alignment defects caused due to disorder of the smectic layer formation (alignment of liquid crystal molecules). As a result, the display panel provides a good and uniform alignment.

The above panel structure may particularly preferably used for providing a good alignment state in case of using a liquid crystal material having a phase transition series including a phase transition on temperature decrease from isotropic phase to smectic phase without assuming cholesteric phase as those of the liquid crystal materials of the structural formulae (1)–(10).

Figure 12:
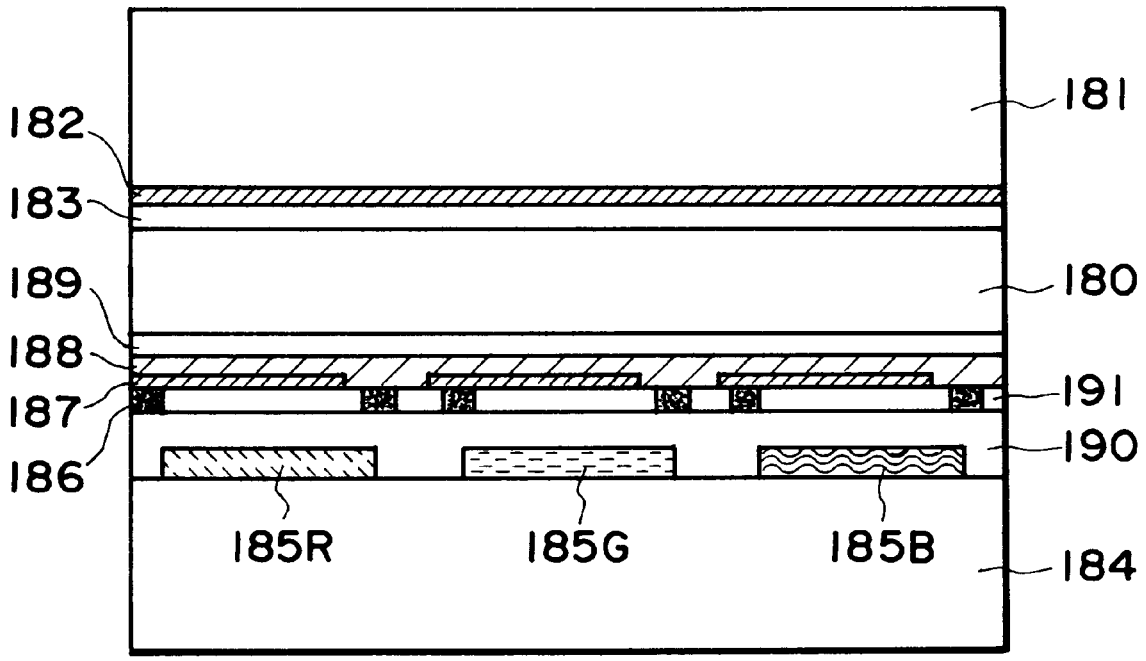
FIG. 12 is a schematic sectional view of an embodiment of a display panel used in a liquid crystal display apparatus according to the first aspect of the present invention.

FIG. 12 is a schematic sectional view of an embodiment of a display panel applicable to the second embodiment (FIG. 7) of the liquid crystal display apparatus according to the first and aspect of the present invention.

Referring to FIG. 12, the display panel includes a pair of transparent substrates 181 and 184 oppositely disposed and provided with electrodes and includes a ferroelectric liquid crystal 180 assuming three stable states disposed between the substrates 181 and 184 with a prescribed spacing or cell gap (e.g., ca. 2.5 $\mu$m).

On one of the substrate 181, scanning electrodes (scanning lines) 182 are formed, and thereon, an alignment control layer 183, e.g., composed of a 5 nm-thick nylon film subjected to rubbing is formed. The nylon film can be replaced with a polyimide film.

On the other substrate 184, a color filter comprising three color filter segments 185R (for red), 185G (for green) and 185B (for blue) is disposed, and thereon, coating layers 190 and 191 for providing a flat (even) surface are successively disposed. On the coating layer 191, data lines 186 are formed, and thereon, pixel electrodes 187 are formed. The data lines 186 and pixel electrodes 187 are inclusively referred to as data electrodes. Further, on the data electrodes, a mixture film 188 of, e.g., $SiO_2$ and $ZrO_2$ for preventing short circuit between the substrates. The mixture film 188 is coated with a surface treatment layer 189 comprising siloxane in a thickness of at most 10 nm.

The surface treatment layer 189 is not subjected to rubbing and accordingly effective in improving a good alignment state in case of using a liquid crystal material having a phase transition series including a phase transition on temperature decrease from isotropic phase to smectic phase similarly as in the case of the display panel shown in FIG. 11.

As described hereinabove, according to the present invention, pixels in a prescribed display region are driven so as to provide the pixels (capable of including at least two sub-pixels) with two bright states, i.e., a ferroelectric second stable state and a ferroelectric third stable state in mixture (combination) wherein both of the stable state are well co-present (balanced), so that flickering particularly observed when a display panel is viewed in an oblique direction is effectively suppressed by minimizing differences in transmittance and hue.

What is claimed is:

1. A liquid crystal display apparatus, comprising:

a display panel including scanning electrodes and data electrodes intersecting the scanning electrodes so as to form a matrix of pixels each comprising two sub-pixels formed at intersections of an adjacent two of the scanning electrodes and one of the data electrodes;

a ferroelectric liquid crystal disposed between the scanning electrodes and the data electrodes and capable of assuming an antiferroelectric first stable state under application of no voltage, and a ferroelectric second stable state and a ferroelectric third stable state under application of voltages corresponding to polarities of the applied voltages;

polarizing means for visually displaying the first stable state of the liquid crystal as a dark state, and the second and third stable states of the liquid crystal as bright states; and drive means for applying voltages to the scanning electrodes and the data electrodes so that, for each pixel displayed in a bright state in each frame, the liquid crystal is placed in the second and third stable states at one and the other of the two sub-pixels on the adjacent two scanning electrodes receiving voltages of mutually opposite polarities.

2. An apparatus according to claim 1, wherein the liquid crystal at each of the sub-pixels is supplied with voltages of polarities alternating for each frame so as to alternately assume the second stable state and the third stable state for each frame to display a bright state.

3. An apparatus according to claim 1, wherein one of the scanning electrodes is selected by applying a first selection voltage of one polarity in synchronism with a first voltage pulse constituting an image signal comprising an alternating signal voltage comprising at least one positive-polarity voltage pulse and at least one negative-polarity voltage pulse while applying the image signal by the drive means at one of the sub-pixels, thereby to display a bright state, and another scanning electrode is selected by applying a second selection voltage of a polarity, opposite to that of the first selection voltage, in synchronism with a second voltage pulse constituting the image signal and having a polarity opposite to that of the first voltage pulse to determine a display state at another sub-pixel, thereby to display a bright state.

4. An apparatus according to claim 1, wherein the drive means supplies a signal voltage waveform having a selection period with application of a selection voltage, a reset period with no voltage application immediately before the selection period, and a non-selection period with application of a bias voltage immediately after the selection period to a scanning electrode concerned with at least one sub-pixel.

5. An apparatus according to claim 1, wherein each of the pixels comprises a region for providing a display state of each of three colors of red, green, and blue.

6. An apparatus according to claim 1, wherein the display panel includes a first substrate provided with the scanning electrodes or the data electrodes, a second substrate provided with the data electrodes or the scanning electrodes, an alignment control layer subjected to rubbing disposed on the first substrate side, and a surface treatment layer comprising siloxane disposed on the second substrate side.

7. An apparatus according to claim 6, wherein the alignment control layer comprises a polyimide film.

8. An apparatus according to claim 6, wherein the alignment control layer comprises a nylon film.

9. An apparatus according to claim 7, wherein the liquid crystal has a phase transition series including a phase transition from isotropic phase to smectic phase on temperature decrease.

10. A method of driving a liquid crystal display apparatus comprising: a display panel including scanning electrodes and data electrodes intersecting the scanning electrodes so as to form a matrix of pixels each comprising two sub-pixels formed at intersections of an adjacent two of the scanning electrodes and one of the data electrodes; a ferroelectric liquid crystal disposed between the scanning electrodes and the data electrodes and capable of assuming an antiferroelectric first stable state under application of no voltage, and a ferroelectric second stable state and a ferroelectric third stable state under application of voltages corresponding to polarities of the applied voltages; and polarizing means for visually displaying the first stable state of the liquid crystal as a dark state, and the second and third stable states of the liquid crystal as bright states, the method comprising the step of applying voltages to the scanning electrodes and the data electrodes by drive means so that, for each pixel displayed in a bright state in each frame, the liquid crystal is placed in the second and third stable states at one and the other of the two sub-pixels on the adjacent two scanning electrodes receiving voltages of mutually opposite polarities.

11. A method according to claim 10, wherein one of the scanning electrodes is selected by applying a first selection voltage of one polarity in synchronism with a first voltage pulse constituting an image signal comprising an alternating signal voltage comprising at least one positive-polarity voltage pulse and at least one negative-polarity voltage pulse while applying the image signal by the drive means at one of the sub-pixels, thereby to display a bright state, and another scanning electrode is selected by applying a second selection voltage of a polarity, opposite to that of the first selection voltage, in synchronism with a second voltage pulse constituting the image signal and having a polarity opposite to that of the first voltage pulse to determine a display state at another sub-pixel, thereby to display a bright state.

* * * * *

UNITED STATES PATENT AND TRADEMARK OFFICE

CERTIFICATE OF CORRECTION

PATENT NO. : 6,061,045

DATED : May 9, 2000

INVENTOR(S) : YUTAKA INABA

It is certified that error appears in the above-identified patent and that said Letters Patent is hereby corrected as shown below:

COLUMN 1

Line 14, "results" should read --result--; and
Line 52, "a" (first occurrence) should read --an--.

COLUMN 3

Line 7, "pixel" should read --a pixel--.

COLUMN 4

Line 62, "aspect" should read --aspects--.

COLUMN 6

Line 47, "(electrodes)" (are" should read --(electrodes)") are--;
Line 53, "pixel" should read --pixels--; and
Line 54, "is constituted" should be deleted.

COLUMN 7

Line 26, "frame As" should read --frame. As--.

COLUMN 8

Line 37, "exceeds" should read --exceed--; and
Line 40, "state" should read --states--.

UNITED STATES PATENT AND TRADEMARK OFFICE

CERTIFICATE OF CORRECTION

PATENT NO. : 6,061,045

DATED : May 9, 2000

INVENTOR(S) : YUTAKA INABA

It is certified that error appears in the above-identified patent and that said Letters Patent is hereby corrected as shown below:

COLUMN 9

Line 8, "liens" should read --lines--;
Line 9, "electrode" should read --electrodes--; and
Line 17, "line" should read --lines--.

COLUMN 10

Line 27, "line" should read --lines--.

COLUMN 12

Line 21, "9D," should read --9D),--.

COLUMN 13

Line 1, "provide" should be deleted; and
Line 11, "line" should read --lines--.

COLUMN 15

Line 52, "substrate" should read --substrates--.

UNITED STATES PATENT AND TRADEMARK OFFICE

CERTIFICATE OF CORRECTION

PATENT NO. : 6,061,045

DATED : May 9, 2000

INVENTOR(S) : YUTAKA INABA

It is certified that error appears in the above-identified patent and that said Letters Patent is hereby corrected as shown below:

COLUMN 16

Line 37, "used" should read --be used--; and
Line 54, "substrate" should read --substrates--.

COLUMN 17

Line 16, "state" should read --states--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*